US007800477B1

(12) United States Patent
Komer

(10) Patent No.: US 7,800,477 B1
(45) Date of Patent: Sep. 21, 2010

(54) THERMAL PROTECTOR

(75) Inventor: John M. Komer, Canton, OH (US)

(73) Assignee: Thermtrol Corporation, North Canton, OH (US)

( * ) Notice: Subject to any disclaimer, the term of this patent is extended or adjusted under 35 U.S.C. 154(b) by 226 days.

(21) Appl. No.: 12/051,567

(22) Filed: Mar. 19, 2008

Related U.S. Application Data

(60) Provisional application No. 60/919,123, filed on Mar. 20, 2007.

(51) Int. Cl.
*H01H 37/52* (2006.01)
*H01H 37/14* (2006.01)

(52) U.S. Cl. ..... 337/102; 337/36; 337/56; 337/72; 337/66; 337/85; 337/59

(58) Field of Classification Search ..... 337/56, 337/72, 66, 85, 59, 36, 102; 200/339, 341; 29/622
See application file for complete search history.

(56) References Cited

U.S. PATENT DOCUMENTS

| | | | | | |
|---|---|---|---|---|---|
| 3,265,839 | A * | 8/1966 | Johnson | 337/91 |
| 3,432,786 | A * | 3/1969 | Vind | 337/95 |
| 3,495,150 | A * | 2/1970 | Enemark | 318/792 |
| 3,525,914 | A | 8/1970 | Vind | 318/792 |
| 3,959,762 | A * | 5/1976 | Senor | 337/102 |
| 4,236,135 | A * | 11/1980 | Holden | 337/89 |
| 4,476,452 | A * | 10/1984 | D'Entremont | 337/102 |
| 4,528,540 | A * | 7/1985 | Stiekel et al. | 337/102 |
| 4,703,298 | A | 10/1987 | Gerson | 337/102 |
| 4,847,587 | A | 7/1989 | Muller | 338/215 |
| 4,862,132 | A * | 8/1989 | Hollweck | 337/102 |
| 4,862,133 | A | 8/1989 | Tabei | 337/102 |
| 5,233,325 | A * | 8/1993 | Takeda | 337/107 |
| 5,309,131 | A | 5/1994 | Hofsass | 337/102 |
| 5,615,072 | A * | 3/1997 | Hofsass et al. | 361/24 |
| 5,936,510 | A | 8/1999 | Wehl | 337/377 |
| 5,973,587 | A * | 10/1999 | Hofsass | 337/377 |
| 6,020,807 | A | 2/2000 | Givler | 337/377 |
| 6,031,447 | A * | 2/2000 | Hofsass | 337/377 |
| 6,181,233 | B1 * | 1/2001 | Hofsass et al. | 337/377 |
| 6,396,381 | B1 * | 5/2002 | Takeda | 337/377 |
| 6,525,640 | B1 * | 2/2003 | Busnello | 337/85 |
| 6,553,611 | B2 | 4/2003 | Huebsch et al. | 15/339 |
| 6,995,647 | B2 * | 2/2006 | Stiekel | 337/112 |
| 7,026,907 | B2 * | 4/2006 | Takeda | 337/85 |
| 7,075,403 | B2 * | 7/2006 | Unno et al. | 337/365 |
| 7,298,239 | B2 * | 11/2007 | Yamada | 337/107 |

(Continued)

*Primary Examiner*—Anatoly Vortman
(74) *Attorney, Agent, or Firm*—Alvin T. Rockhill

(57) ABSTRACT

The present invention relates to a thermal protector which is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical resistor generates sufficient heat to keep the bimetal blade above a reset temperature and to maintain the bimetal blade in a bent position wherein the moving electrical contact remains away from the fixed electrical contact during periods of continued application of the electrical current, wherein the reset temperature is above ambient temperature, and wherein the thermal protector is capable of at least 60 cycles of operation at a peak amperage of at least 90 amps at 120 volts of alternating current.

18 Claims, 10 Drawing Sheets

U.S. PATENT DOCUMENTS 7,301,434 B1 * 11/2007 Pisuk et al. ..... 337/368
7,330,097 B2 * 2/2008 Takeda ..... 337/102
2006/0163956 A1 * 7/2006 Sahashi et al. ..... 310/68 C

* cited by examiner

THERMAL PROTECTOR

This application claims the benefit of the priority of U.S. Provisional Patent Application Ser. No. 60/919,123 filed on Mar. 20, 2007. The teachings of U.S. Provisional Patent Application Ser. No. 60/919,123 are incorporated herein by reference in their entirety.

BACKGROUND OF THE INVENTION

It is desirable for electrical devices, particularly electrical devices that include an electric motor, to be equipped with a thermal protector that will stop operation of the device in the event that the operating temperature of the device exceeds a predetermined maximum operating temperature. Stopping the device is desirable because it can prevent mechanical damage from occurring and frequently can prevent an electrical motor from operating at unacceptably high temperatures. A number of devices that perform this general function are know in the prior art.

U.S. Pat. No. 6,553,611 discloses a thermal protector device for utilization in conjunction with vacuum cleaners. In vacuum cleaners, overheating of the motor typically results from a blocked or plugged filter, or from one or more objects interfering with the operation of the rotating brush or floor element. U.S. Pat. No. 6,553,611 discloses a vacuum cleaner comprising: a lower base unit; an upper enclosure being pivotable with respect to the lower base unit; a motor disposed within the lower base unit; a power cord having a first end affixed to at least one of said upper portion and said base unit, and a second end adapted for connecting to an electrical power source; electrical conductors extending between said first end of said power cord and said motor, said electrical conductors defining an electrical power circuit to said motor; and a thermal cutoff assembly including a temperature sensor disposed proximate to said motor for measuring the temperature of said motor, said thermal cutoff assembly further including a switching element in electrical association with said electrical conductors, wherein upon the temperature sensor sensing a temperature greater than a predetermined temperature setpoint, said switching element opens said electrical power circuit; wherein once said switching element has opened said electrical power circuit, said switching element closes said electrical power circuit only upon the temperature sensor sensing a temperature less than the predetermined temperature setpoint and after said thermal cutoff assembly has been disconnected from said electrical power source.

U.S. Pat. No. 4,703,298 discloses a thermostat that includes ceramic mounting pins that are made of ceramic PTC material. The thermostat is a non-enclosed device and is, therefore, subject to atmospheric conditions. Two metal contact carriers are fastened onto parallel pins. Carriers are selectively moveable relative to each other on pins, so that the thermostat can be adjusted for a specific circuit opening temperature. The thermostat is required to be non-enclosed to permit the carriers to move with respect to the pins.

In use, when the bimetal moves to the open position, the temperature is such that the resistance of the PTC material is substantial, so that the current which now flows through the pins generates sufficient heat to keep open the circuit between carriers. This current flow, together with the selective resistivity of the pins at this temperature, is sufficient to maintain the bimetal above its reset temperature even though the ambient temperature being monitored by the thermostat may return to its original or normal level. The thermostat thus remains open until it is allowed to reset because it has been disconnected from the circuit, whereby the heat source is removed and the bimetal is permitted to snap to the closed contact position because it is at a temperature below the reset temperature.

U.S. Pat. No. 3,525,914 discloses a thermo switch that includes a ceramic PTC heat resistor that is mounted between the inner surfaces of the bimetallic strips. Similarly, U.S. Pat. No. 5,309,131 discloses utilizing a PTC resistor mounted between a fixed contact and a moveable contact. In all these disclosures, current flows through the PTC resistor regardless of whether the switch is open or closed. The resistance of the PTC resistor increases with increasing ambient temperature. The switches of U.S. Pat. No. 4,703,298, U.S. Pat. No. 3,525,914, and U.S. Pat. No. 5,309,131 open when the ambient temperature is above the reset temperature. The PTC resistor in each is designed to generate a sufficient amount of heat so that the temperature is above the reset temperature to maintain the switch open. Thus, the switch of either U.S. Pat. No. 4,703,298, U.S. Pat. No. 3,525,914, and U.S. Pat. No. 5,309,131 remains open until the load current is removed.

A PTC resistor is designed to have a relatively low resistance when the ambient temperature is below a threshold value. Thus, when the switch is closed, current flows through the PTC resistor, but because the resistance is relatively low, an insufficient amount of heat is generated to increase the temperature at the thermostat above the actuation level. Only when the ambient temperature rises above a predetermined point is the resistance of the PTC sufficient to generate significant heat.

For many uses it is desirable for the thermostat to be enclosed, sealed from the local ambient conditions to ensure the efficient operation of the thermostat. Sealed thermostats can be calibrated or adjusted for a specific circuit opening temperature by distorting the case at a predetermined location as is well known in the art (see, for example, U.S. Pat. No. 3,443,259 and U.S. Pat. No. 3,223,808).

U.S. Pat. No. 5,936,510 discloses a thermostat comprising: (1) a case having a sealed interior and an exterior; (2) a contact extending from said sealed interior to said exterior, said contact being fixed with respect to said casing and having an interior contact position; (3) a first blade extending from said sealed interior to said exterior, said first blade having an interior end, said interior end of said first blade moving between a first position where said interior end of first blade abuts said interior contact position of said contact and a second position where said interior end of said first blade is spaced from said interior contact position of said contact; (4) a separator disposed between said contact and said first blade in said interior of said case, said separator being made of an insulating material, said separator having a first side facing said contact and a second side facing said first blade; (5) a first conductive contact pad disposed on said first side of said separator; (6) a second conductive contact pad disposed on said second side of said separator; and (7) a resistor disposed within said separator being electrically connected between said first conductive contact pad and said second conductive contact pad, said resistor having a sufficient resistance so that when said interior end of said first blade moves from said first position to said second position a sufficient amount of heat is generated by said resistor to maintain said interior end of said first blade in said second position until a load current being applied to said contact and said first blade is removed.

U.S. Pat. No. 6,020,807 discloses a thermostat comprising: (1) a case made of conductive material, said case having an exterior; (2) a cover plate made of a conductive material, said cover plate being connected to said case to define a sealed interior, said cover plate having a contact projecting into said sealed interior, said contact being fixed with respect to said case and having an interior contact position; (3) an insulator sheet disposed between said case and said cover plate; (4) a blade disposed in said sealed interior, said blade having a second end, said second end of said blade moving between a first position where said second end of said blade abuts said contact position of said contact and a second position where said second end of said blade is spaced from said interior contact position of said contact; and (5) a resistor mounted on a first end of said blade, said resistor being disposed between said cover plate and said blade in said sealed interior of said case, said resistor having a first side facing and abutting said cover plate and a second side facing and abutting said blade so that said resistor is electrically connected between said cover plate and said blade, said resistor having a sufficient resistance so that when said second end of said blade moves from said first position to said second position a sufficient amount of heat is generated by current flowing through said resistor to maintain said second end of said blade in said second position until a load current applied to said cover plate and said blade is removed.

U.S. Pat. No. 5,309,131 discloses a thermal switch having two connecting parts fixed to a support part. One connecting part carries a fixed contact and the other connecting part is connected through a high resistance to a movable contact switchable by a bimetallic element. The support part is a ceramic part forming the high resistance from a PTC material and the connecting parts are almost completely frictionally engage support part.

U.S. Pat. No. 4,847,587 discloses a bimetal thermoswitch consisting of an electrically insulating, flat carrier, at least two electric terminals which are secured to the carrier and are respectively connected to a fixed contact, which is mounted on the carrier, and to a contact spring, which is secured at one end to the carrier and at its other end carries a movable contact element, which cooperates with the fixed contact. The carrier consists of an alumina ceramic slab.

U.S. Pat. No. 4,862,133 discloses a small-size thermal switch having a base formed of an electrically conductive plastic. The thermal switch is arranged such that, after a bimetallic element deflects in a reverse direction and opens the circuit of the thermal switch, the bimetallic element is self-held in such a reversely deflected state and the self-held state of the bimetallic element is maintained until an electrical power source is switched off. U.S. Pat. No. 4,862,133 further provides a thermal switch in which one surface of its movable-contact leaf spring is maintained in contact with the surface of its bimetallic element which is formed of a metal having the lower coefficient of expansion. Since the bimetallic element is sandwiched between the base and the movable contact, the stability of the bimetallic element in a recess of the base is improved.

There is currently a need for a thermal protector which is capable of continuous operation at 20 amps and preferably at 25 amps or greater at 120 volts of alternating current having a self hold feature which will not allow current to be restored on cooling without breaking the supply of electrical current by unplugging the device from its electrical supply or switching off the electrical supply to the device. There is also a need for such a thermal protector that will also break the hold of current on detection of unacceptably high currents. There is a further need for a self hold thermal protector which is capable of at least 60 cycles of operation at a peak amperage of at least 90 amps at 120 volts of alternating current. However, self hold thermal protectors that are available today are not capable of this combination of needed characteristics.

SUMMARY OF THE INVENTION

The present invention relates to a thermal protector for use with electrical devices, such as electric motors, that breaks the supply of electrical current to the device upon detecting an elevated temperature that is above a preset cutoff temperature or upon detecting an elevated electric current. This thermal protector operates by a cutoff assembly that disconnects electrical power to the device at the elevated temperature and can withstand 60 cycles of operation at greater than 90 amps and preferably greater than 100 amps under fault conditions at 120 volts of alternating current. The thermal protector of this invention also incorporates a self hold feature that prevents the electrical device from being restarted until its power source has been manually disconnected and again reconnected after the bimetal has cooled to a temperature below the reset temperature. This feature prevents the device from cooling and restarting without addressing the underlying problem that caused the overheat condition. The reset temperature will be above ambient temperature and will typically be a temperature of at least 30° C. The reset temperature will more typically be a temperature in excess of 40° C. and will often be a temperature of at least 50° C.

The self hold thermal protectors of this invention are based upon the discovery that the moving contact utilized therein must have a minimum volume of at least 0.0003 inches$^3$ to attain the desired level of performance. In other words, for the device to be capable of reliable operation for at least 60 cycles of operation (wherein the moving contact is pulled away from the fixed electrical contact by the thermally induced bending caused by heating of the bimetal blade by virtue of an elevated level of current) at a peak amperage of at least 90 amps at 120 volts of alternating current it is necessary for the moving contact to have this minimum volume. In evaluating this performance characteristic the thermal protector will be reset as quickly as possible after it has opened the circuit to subject the thermal protector to the cycles of operation. In some cases, it is also necessary for the device to be able to reliably operate for at least 60 cycles at peak amperages of at least 40 amps at 240 volts of alternating current. It is also desirable for more reliable operation and in some cases to facilitate manufacturing for the resistor component of the thermal protector to be comprised of 2 or more thermal resistors. For instance, in multiple resistor designs, if one resistor fails other resistors are present to provide heat which is sufficient to keep the bimetal blade above its reset closing temperature. Therefore, the thermal protector will continue to properly function even in the event that a thermal resistor has failed. The electrical resistor used in the thermal protectors of this invention is typically a positive temperature coefficient (PTC) resistor.

The subject invention more specifically reveals a thermal protector which is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 in$^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein the moving electrical contact remains away from the fixed electrical contact at temperature above the reset temperature, wherein at temperatures below the reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature, and wherein the thermal protector is capable of at least 60 cycles of operation at a peak amperage of at least 90 amps at 120 volts of alternating current.

The present invention further reveals a thermal protector which is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature, and wherein the fixed electrical contact remains in electrical contact with the moving electrical contact during continuous operation at an amperage of at least 20 amps at 120 volts of alternating current.

The present invention further reveals a thermal protector which is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature, and wherein the thermal protector is capable of at least 60 cycles of operation at a peak amperage of at least 40 amps at 240 volts of alternating current.

The subject invention further discloses a thermal protector which is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature, and wherein the fixed electrical contact remains in electrical contact with the moving electrical contact during continuous operation at an amperage of at least 15 amps at 240 volts of alternating current.

The present invention also discloses an electric motor having a housing, an armature, and a coil, wherein the electric motor is powered by electricity from an electric circuit, wherein a thermal protector is included in the electric motor, wherein the thermal protector is wired in series with the electric circuit that powers the electric motor, wherein the thermal protector is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature. Such electric motors can by powered by alternating current or direct electrical current. In many cases it is advantageous to affix the thermal protector to the coil of the motor.

The subject invention also reveals an air compressor which includes an air tank, a means for forcing air into the air tank, and an electric motor for powering the means for forcing air into the air tank wherein the electric motor has a thermal protector, wherein the thermal protector is wired in series with the electric circuit that powers the electric motor, wherein the thermal protector is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature. The means for forcing the air into the air tank can be a turbine, an impeller, a reciprocating piston, or a helical screw. The air compressor can be a centrifugal air compressor, an axial-flow air compressor, or a rotary screw air compressor.

The subject invention also discloses a conveyor which is comprised of a conveyor belt and an electric motor for driving the conveyor belt, wherein the electric motor has a thermal protector, wherein the thermal protector is wired in series with the electric circuit that powers the electric motor, wherein the thermal protector is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature.

The present invention also reveals a washing machine which includes a housing, an agitator tub, a water inlet, a water outlet, and an electric motor, wherein the electric motor has a thermal protector, wherein the thermal protector is wired in series with the electric circuit that powers the electric motor, wherein the thermal protector is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature.

The subject invention also discloses a central vacuum system for a building that includes a series of vacuum pipes, a vacuum pump, and an electric motor, wherein the electric motor has a thermal protector, wherein the thermal protector is wired in series with the electric circuit that powers the electric motor, wherein the thermal protector is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature.

The present invention further reveals a ventilation fan that includes a fan blade and an electric motor, wherein the electric motor has a thermal protector, wherein the thermal protector is wired in series with the electric circuit that powers the electric motor, wherein the thermal protector is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature.

The subject invention also discloses a vacuum cleaner that includes a housing, a vacuum pump, a dust collector, and an electric motor, wherein the electric motor has a thermal protector, wherein the thermal protector is wired in series with the electric circuit that powers the electric motor, wherein the thermal protector is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature.

The subject invention also discloses an arc welder that includes a power supply, a first electrode, a second electrode, and a thermal protector, wherein the thermal protector is wired in series with the power supply, wherein the thermal protector is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature.

The present invention further discloses a garbage disposal that includes a shredder housing, a drain outlet, a sink inlet, a dishwasher inlet, a shredder ring, a flywheel, at least two flyweights that are affixed to the flywheel, and an electric motor that is adapted for turning the flywheel, the improvement which comprises utilizing a thermal protector that is wired in series with the electric circuit that powers the electric motor, wherein the thermal protector is comprised of a bimetal blade, a moving electrical contact, a fixed electrical contact, and a electrical resistor, wherein the bimetal blade has a fixed end and a moving end, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, wherein the reset temperature is above ambient temperature.

DETAILED DESCRIPTION OF THE INVENTION

Figure 1:
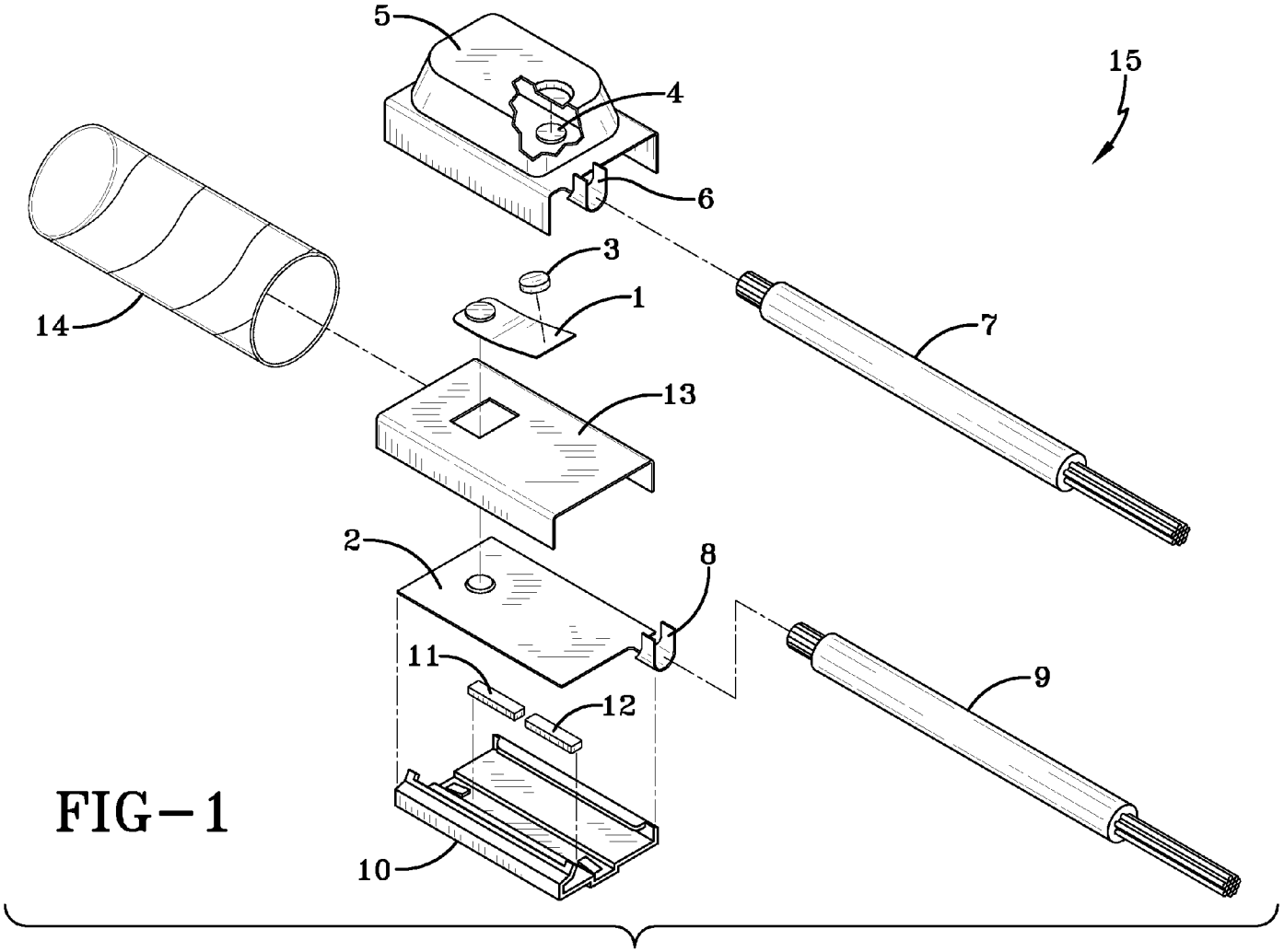
FIG. 1 is an exploded view of a self hold thermal protector of this invention showing the bimetal blade, moving electrical contact, fixed electrical contact and two electrical resistors.

The self hold thermal protectors of this invention are capable of being used in conjunction with a wide variety of electrical devices. For instance, these thermal protectors can be used to protect electrical devices containing electric motors and electrical transformers from damage caused by abnormal operation which results in an abnormally high temperature or an abnormally high current load. In many cases, the thermal protector will be affixed to the electrical windings of the electric motor to more quickly break the electrical circuit to the motor upon detection of an abnormally high temperature or current. It is desirable to affix the thermal protector to the windings of the electric motor or to a position within close proximity to the electric windings since they are the source of the high heat generated during abnormal operation. Accordingly, the thermal protector will be able to act more quickly in response to abnormal operation in cases where it is positioned near the electrical windings. However, the thermal protectors of this invention can be positioned in other areas of the motor or on the motor housing and will still be capable of providing the device with an acceptable level of thermal and electric current protection. The thermal protector can also be located in the airflow of the motor or entirely away from the motor in cases where primarily protection against current overload is desired.

The self hold thermal protectors of this invention are of greatest value for use in conjunction with moderately large electric motors for washing machines, vacuum cleaners, automotive applications, air compressors, air conditioner compressors, industrial machinery, floor buffers, universal electric motors, pumps, aerators, spas, electric welders, industrial food mixers, blenders, processors, drum mixers, industrial blowers, air moving systems, conveyor motors, dishwashers, under sink garbage disposals, grinders, garbage compactors, dryer motors, central vacuum motors, fan motors for ventilation, food processing washdown motors, hatchery/incubator motors, speed reducers, door operator motors, high pressure grain dryers, brake motors, milk transfer pump motors, hydraulic pump motors, refrigerated air dryers, spin dryers, conveyor motors, pressure washers, livestock auger drive feed systems, bran cleaner systems, and bulk feed systems. The thermal protectors of this invention can also be used to prevent overheating of blowers, compressors, pumps and the enclosures of a wide variety of consumer and industrial product, such as vacuum cleaner housings and electrical equipment enclosures.

The critical components of the thermal protectors of this invention include a bimetal blade, a moving electrical contact, a fixed electrical contact, and an electrical resistor. The bimetal blade is comprised of a metal having a higher coefficient of thermal expansion on one side thereof and a metal having a lower coefficient of thermal expansion on the other side thereof. In the non-deformed state (during normal operation below the preset cutoff temperature) the moving electrical contact is held in contact with the fixed electrical contact by the bimetal blade. However, at temperatures above the preset cutoff temperature (switching temperature) the bimetal blade bends due to the expansion of the metal having the higher coefficient of thermal expansion to pull the moving contact away from the fixed contact breaking the flow of electricity through the contacts. The bimetal blade will typically be designed in a manner whereby it snaps into the bent position to rapidly pull the moving electrical contact away from the moving electrical contact. At temperature below a reset temperature (which will ordinarily be above ambient temperature) the bimetal blade will bend back into its original position putting the moving electrical contact into electrical association with the fixed electrical contact.

The moving electrical contact is affixed toward the moving end of the bimetal blade. The moving electrical contact will have a contact surface area that substantially corresponds to the contact surface of the fixed electrical contact and will be made with a metal having good electrical conductivity, such as copper, silver, gold, platinum, or an alloy thereof. It is critical for the moving electrical contact to have a volume of at least 0.0003 $in^3$. The moving electrical contact will typically have a volume of at least 0.0004 $in^3$ and will preferably have a volume of at least 0.0008 $in^3$. It is more preferred for the moving electrical contact to have a volume of at least 0.001 $in^3$. It is most preferred for the moving electrical contact to have a volume of at least 0.0015 $in^3$.

The fixed electrical contact will typically have a contact surface that generally corresponds to the surface of the moving electrical contact. It will typically be made utilizing the same metal that is employed in making the moving electrical contact.

The electrical resistor can be made utilizing a wide variety of compositions that provide a relatively high level of electrical resistance. For instance, the resistor can be made utilizing a composition containing about 90 weight percent calcium borosilicate glass with the balance of the composition being less than 10 weight percent ruthenium dioxide powder and less than 1 weight percent manganese dioxide. The electrical resistor can also be a positive temperature coefficient (PTC) resistor. The positive temperature coefficient resistor can be of parallelepiped design manufactured from barium titanate or solid solutions of barium titanate and strontium titanate with further additives.

FIG. 1 depicts the self hold thermal protector of this invention. In this device, the bimetal blade 1 is attached to the conductive metal plate 2. In this design, electrical current flows from the conductive metal plate 2 through the bimetal blade to the moving electrical contact 3. The moving electrical contact 3 has a minimum volume of at least 0.0003 $in^3$. During normal operation at temperatures below the switching temperature of the device the moving electrical contact is held against the fixed electrical contact 4 by the bimetal blade 1. Since in this design the side of the bimetal blade having the higher coefficient of thermal expansion is on the same side of the blade as the moving electrical contact, if temperatures above the preset switching temperature are encountered, the bimetal blade 1 quickly snaps to an open position pulling the moving electrical contact 3 away from the fixed electrical contact 4 to break the circuit between the two contacts. The fixed electrical contact 4 is affixed to the can 5 so that current can flow through the conductive can 5 to a can terminal 6 and on to a first electrical wire 7.

The bimetal blade 1 is attached to the conductive metal plate 2. A plate terminal 8 is attached to the conductive metal plate 2 so that electrical current can flow through the conductive metal plate 2 to the plate terminal 8 and on to a second electrical wire 9. A conductive metal clip 10 is attached to the can 5 and is in electrical contact with the can 5. However, the conductive metal clip 10 is not in electrical contact with the conductive metal plate 2. A first PTC resistor 11 and a second PTC resistor 12 are held in contact with the conductive metal plate 2 by the conductive metal clip 10. Thus, PTC resistor 11 and PTC resistor 12 are electrically in contact with the conductive metal clip 10 and the conductive metal plate 2. A non-conductive gasket 13 is positioned between the conductive metal plate 2 and the can 5 to prevent the flow of electrical current directly between the conductive metal plate 2 and the can 5. The non-conductive gasket 13 can be made of a non-conductive material. Optionally, a non-conductive sleeve 14 is used to cover the conductive components of the thermal protector. The non-conductive sleeve can be made utilizing a temperature resistant polymer or other appropriate high temperature resistant non conductive material.

Figure 2:
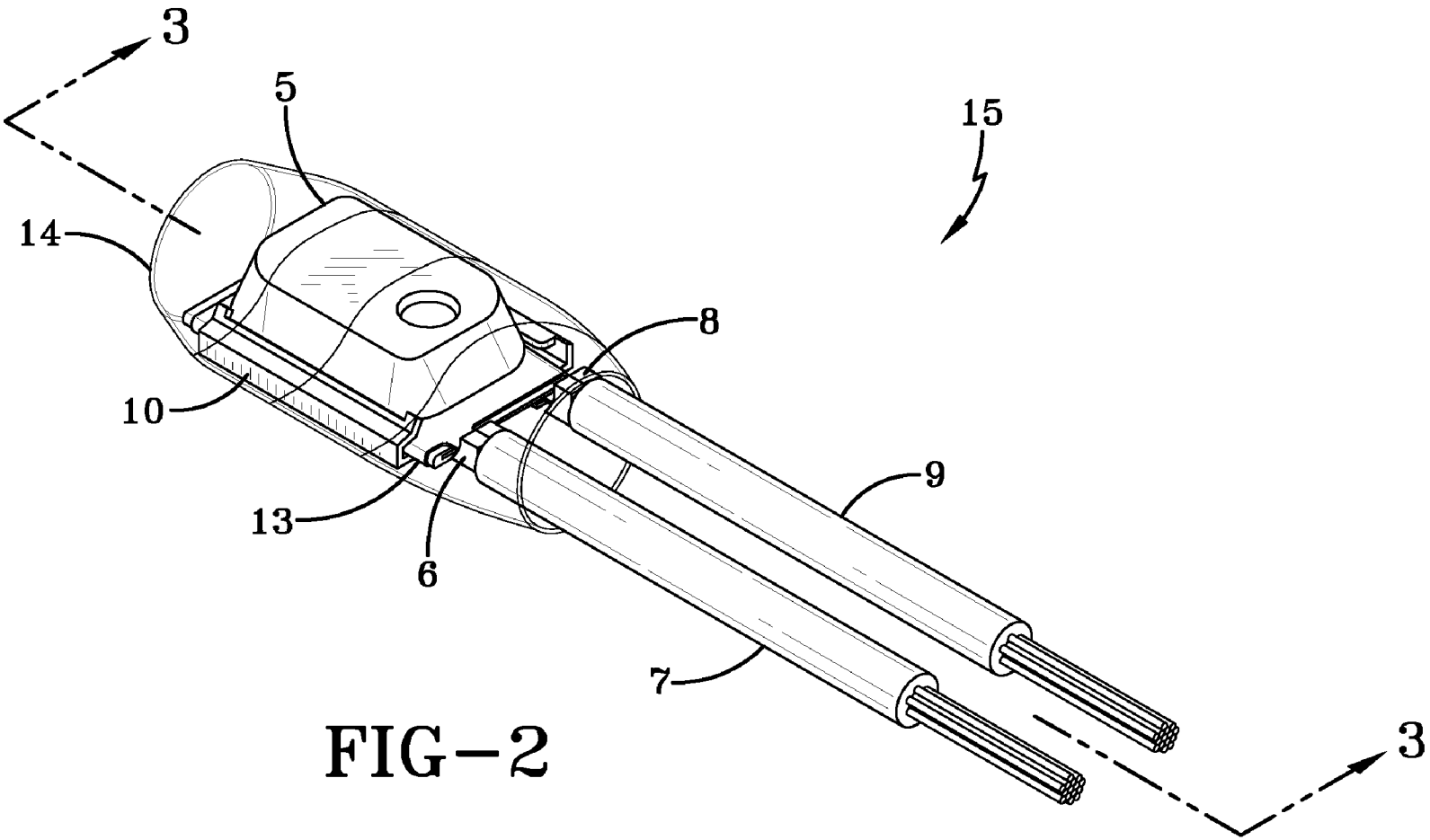
FIG. 2 is a perspective view illustrating the self hold thermal protector of claim 1 as fully assembled.

FIG. 2 shows the self hold thermal protector 15 as fully assembled with the optional non-conductive sleeve 14 covering the conductive components of the device. The first electrical wire 7 and the second electrical wire 9 are wired in series into the circuit which operates the device being protected such as an electric motor.

Figure 3:
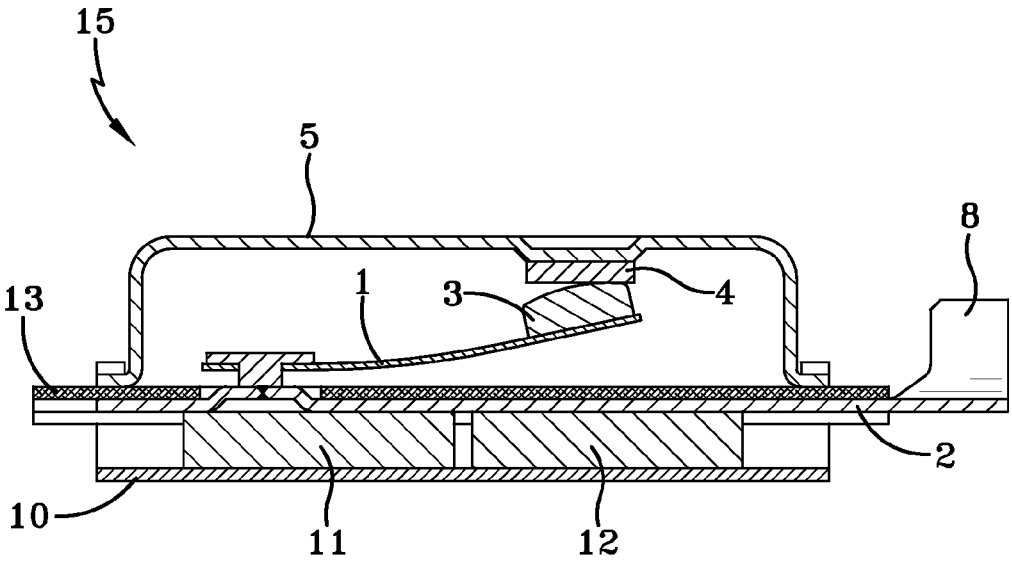
FIG. 3 is a sectional view of a thermal protector of this invention showing the moving contact in a closed position with respect to the fixed contact illustrating normal operation of the device below its preset switching temperature.

FIG. 3 is a section view showing the self hold thermal protector of this invention in its normal operating mode below the preset maximum switching temperature. As can be seen, FIG. 3 shows the moving electrical contact 3 being held by the bimetal blade 1 held against the fixed electrical contact 4. In this position, an electrical circuit is completed between the moving electrical contact 3 and the fixed electrical contact 4. Thus, electrical current can flow through the bimetal blade 1, the moving electrical contact 3 and on through the fixed electrical contact 4. Electrical current flows through the bimetal blade 1 as depicted in FIG. 3 without the resistance of the bimetal blade creating sufficient heat to exceed the preset switching temperature. However, if the level of current flowing through the bimetal blade 1 exceeds a determined level the heat generated by electrical resistance in the bimetal blade 1 will exceed the switching temperature causing the bimetal blade to snap away from the fixed electrical contact 4 opening the circuit between the moving electrical contact 3 and the fixed electrical contact 4. Heat from the environment surrounding the thermal protect can, in another scenario, can also cause the switching temperature to be exceeded again causing the circuit to open.

Figure 4:
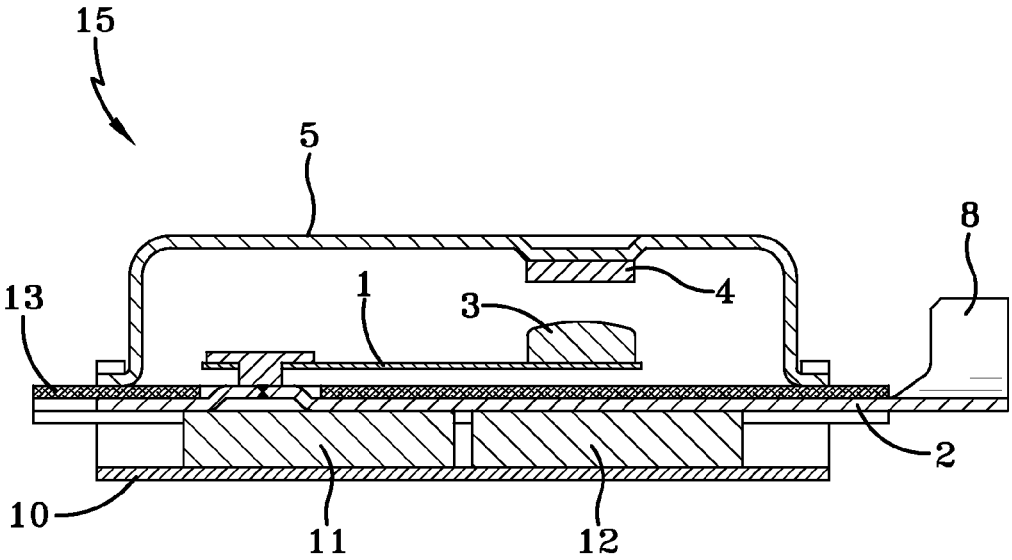
FIG. 4 is a sectional view of the self hold thermal protector of this invention illustrating the moving contact in an open position away from the fixed contact to illustrate its position above the preset thermal switching temperature.

FIG. 4 depicts the self hold thermal protector of this invention wherein the bimetal blade 1 has snapped into an open position pulling the moving electrical contact 3 away from the fixed electrical contact 4. In this position, electrical current does not flow through the bimetal blade 1 so no heat is generated by the bimetal blade 1 to keep it above the reset temperature. However, sufficient heat to keep the bimetal blade 1 above its switching temperature is generated by the electrical current flowing through the first PTC resistor 11 and the second PTC resistor 12. Because the electrical circuit through the bimetal blade 1 has opened, the current must flow though the PTC resistors. In this state where the electrical circuit through the bimetal blade has been opened the electrical current flowing though the PTC resistor is insufficient to operate the device being protected, such as an electric motor.

Figure 5:
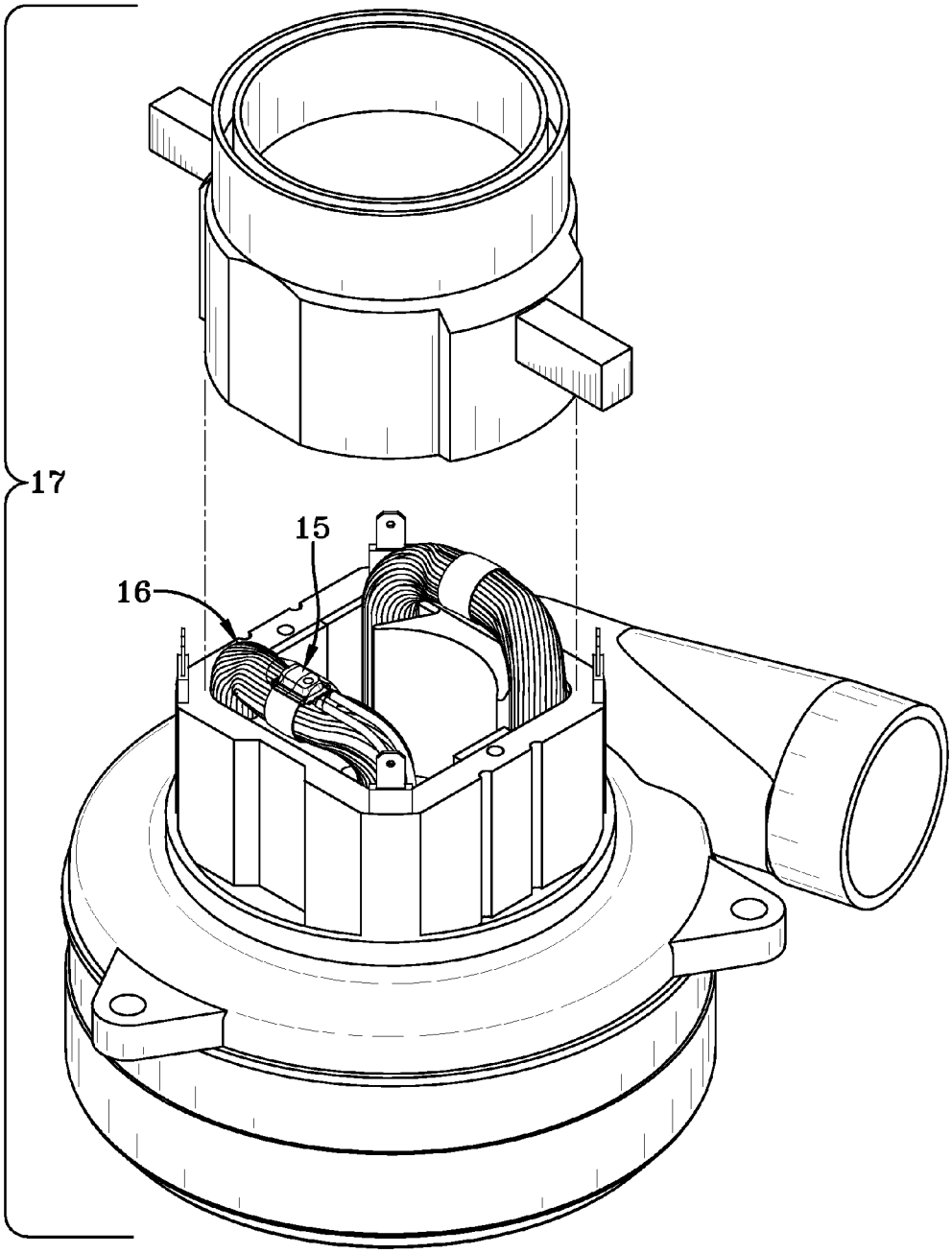
FIG. 5 is a partially exploded perspective view of a typical electric motor application showing the self hold thermal protector affixed to the electrical windings of the motor.

FIG. 5 illustrates the self hold thermal protector 15 of this invention as affixed to an electrical winding 16 in a typical motor blower assembly 17. The thermal protector is typically attached to the winding with strapping such as tape, metal, string or a tie wrap.

Figure 6:
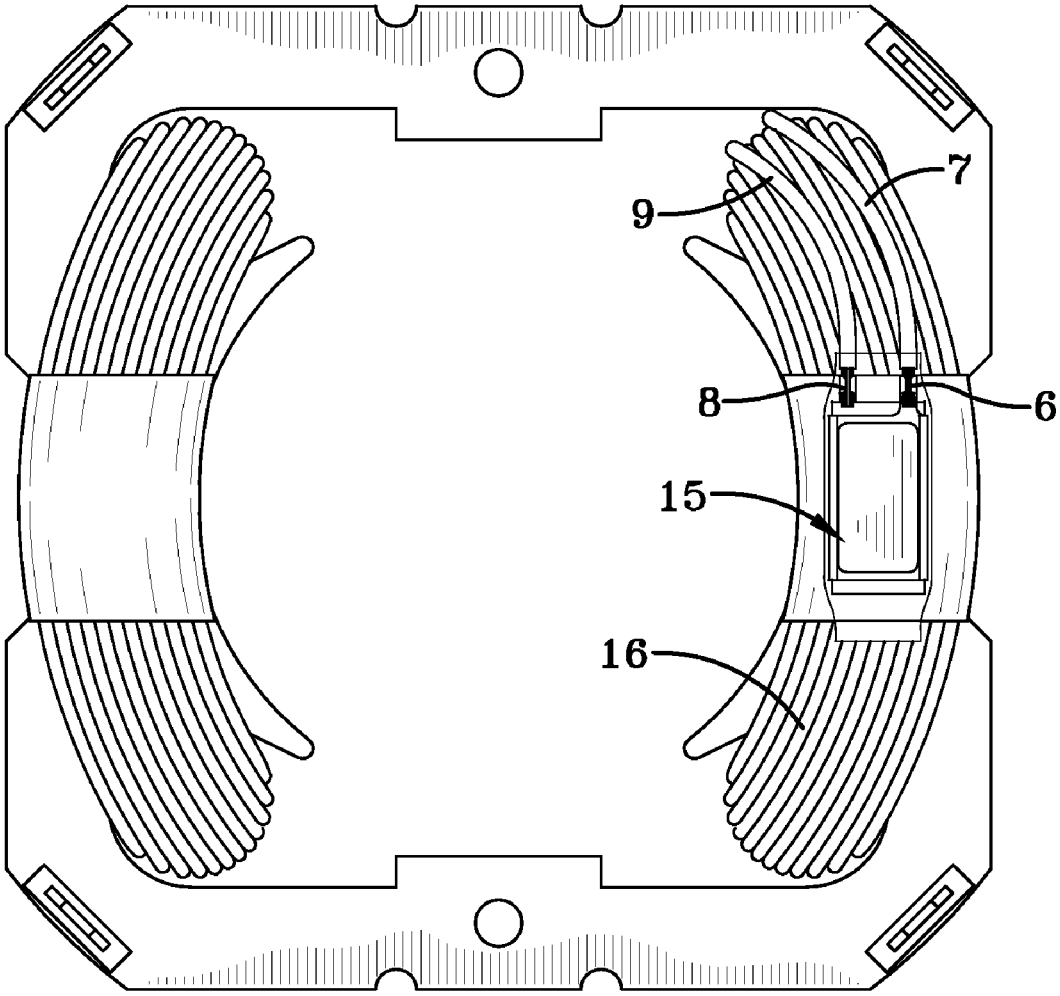
FIG. 6 is a top view showing the self hold thermal protector affixed to the electrical windings of an electric motor.
Figure 7:
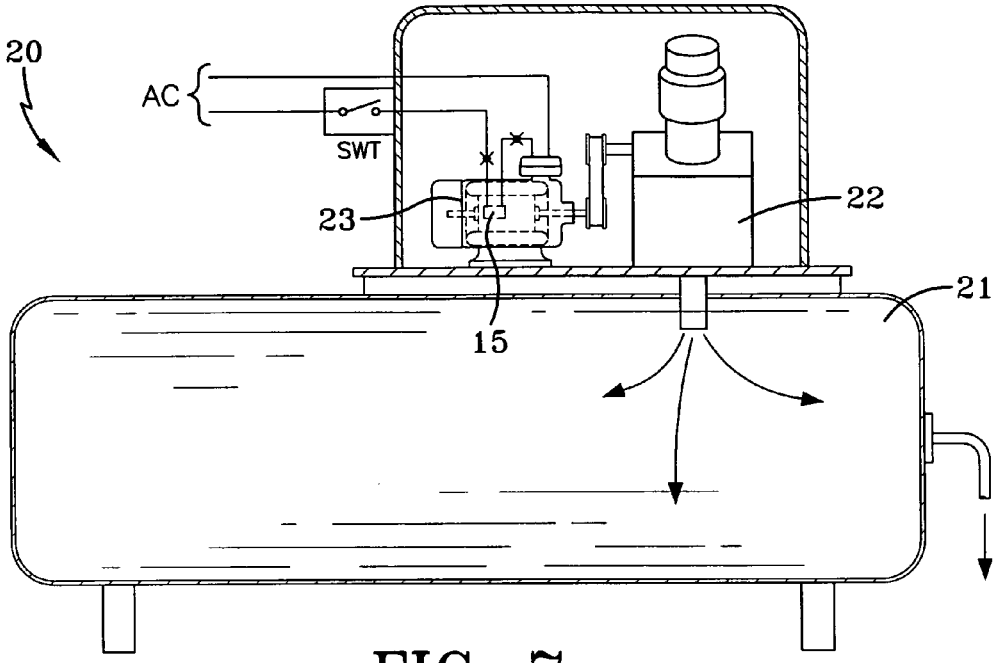
FIG. 7 is a schematic view illustrating an air compressor air compressor 20 which includes an air tank 21, a means for forcing air into the air tank 22, and an electric motor 23 which is equipped with the self hold thermal protector 15.
Figure 8:
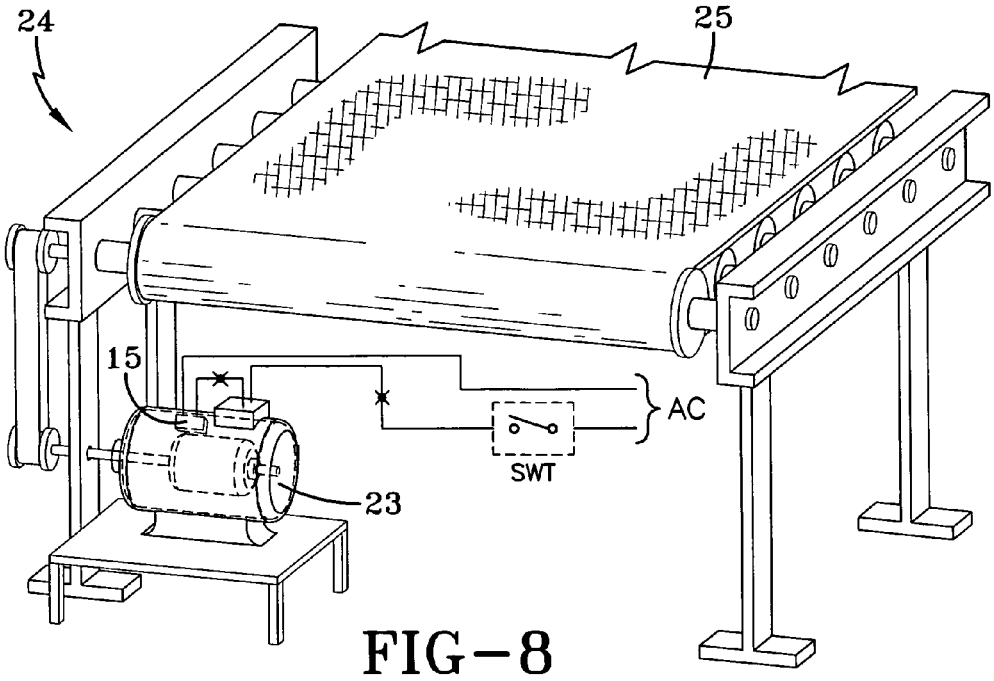
FIG. 8 is a schematic prospective view illustrating a conveyor 24 which includes a conveyor belt 25 and an electric motor 23 which is equipped with the self hold thermal protector 15.
Figure 9:
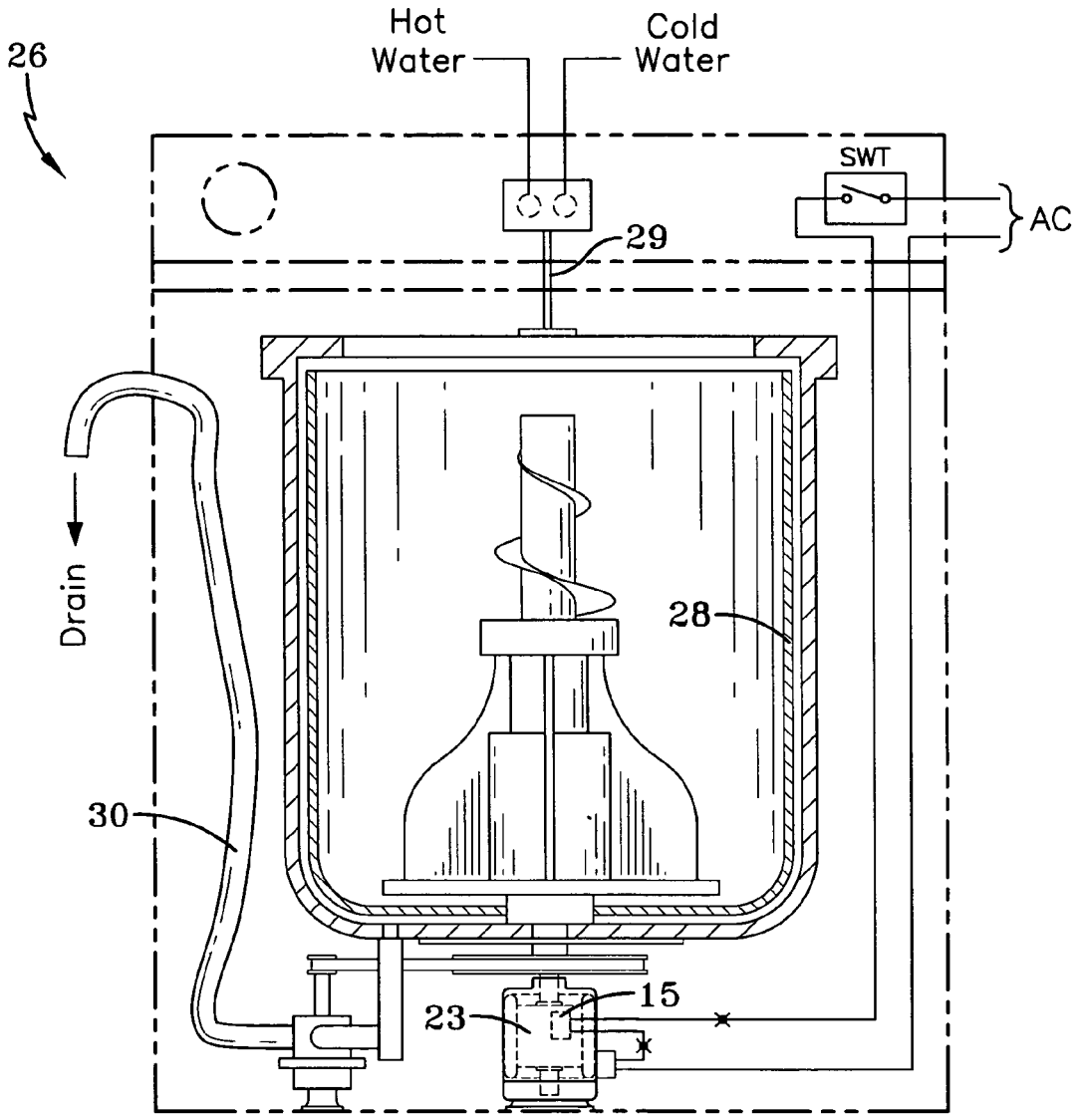
FIG. 9 is a schematic view illustrating a washing machine 26 having a housing 27, an agitator tub 28, a water inlet 29, a water outlet 30, and an electric motor 23 which is equipped with the self hold thermal protector 15.
Figure 10A:
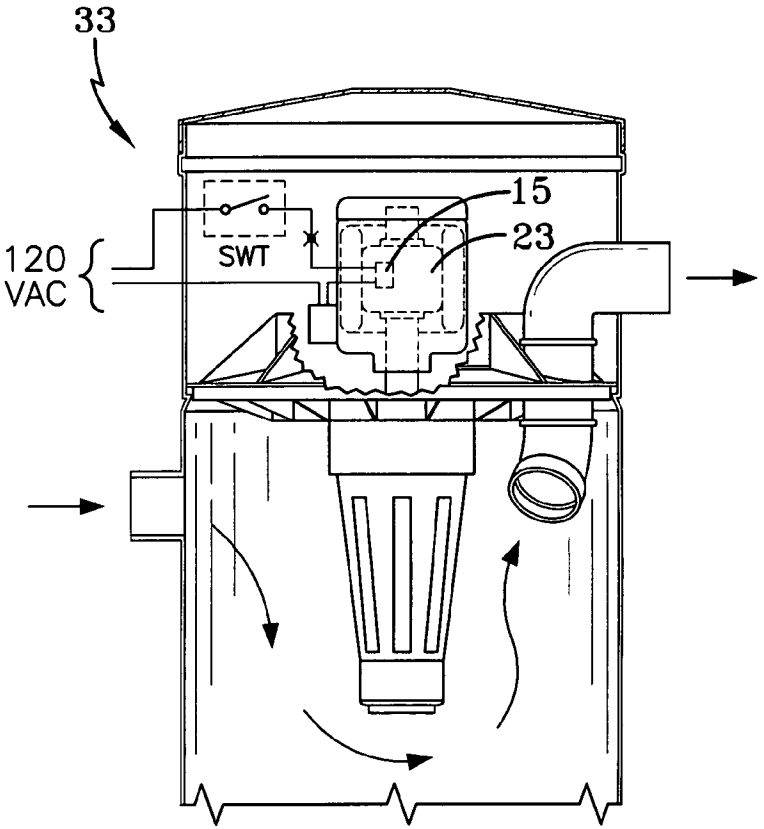
FIG. 10A is a more detained schematic view of the vacuum pump 33 which illustrated the electric motor 23 which is equipped with the self hold thermal protector 15.
Figure 10:
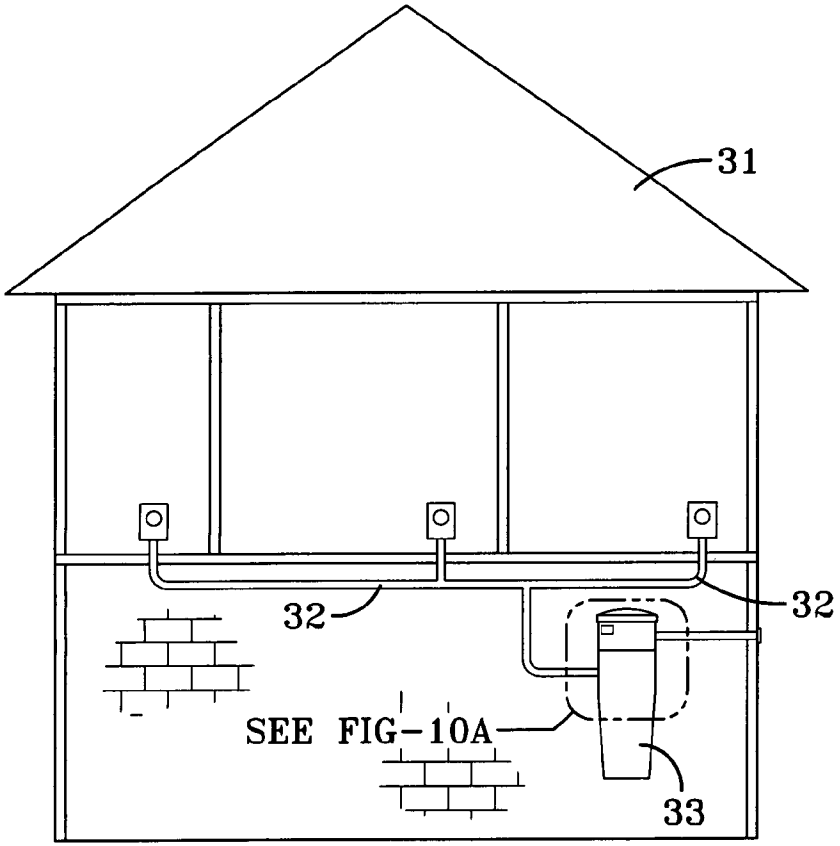
FIG. 10 is a schematic view illustrating a central vacuum system which includes a building 31, vacuum pipes 32, and a vacuum pump 33.
Figure 11:
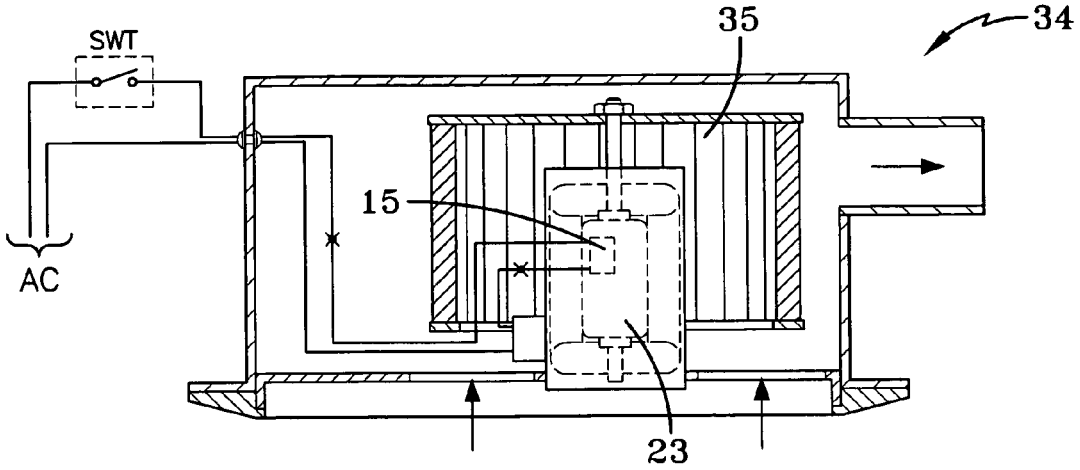
FIG. 11 is a schematic view illustrating a ventilation fan 34 which includes a fan blade 35 and an electric motor 23 which is equipped with the self hold thermal protector 15.
Figure 12:
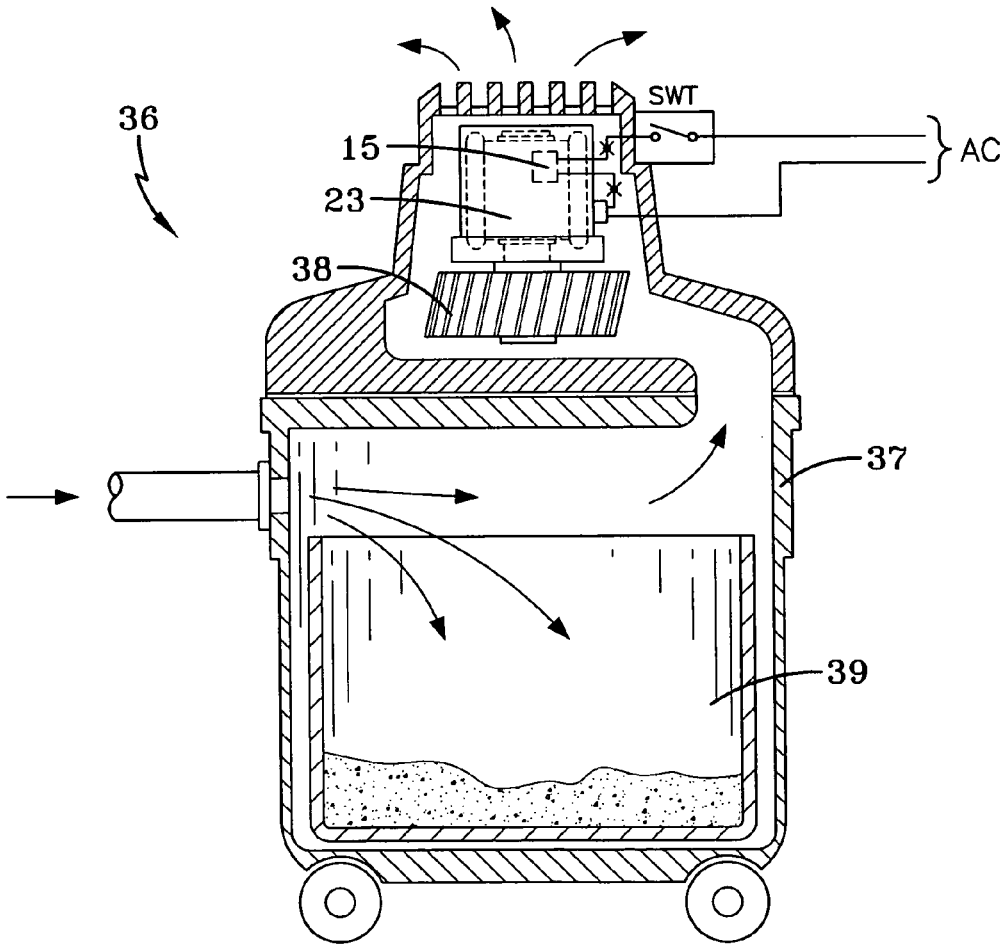
FIG. 12 is a schematic view illustrating a vacuum cleaner 36 which includes a housing 37, a vacuum pump 38, a dust collector 39, and an electric motor 23 which is equipped with the self hold thermal protector 15.
Figure 14:
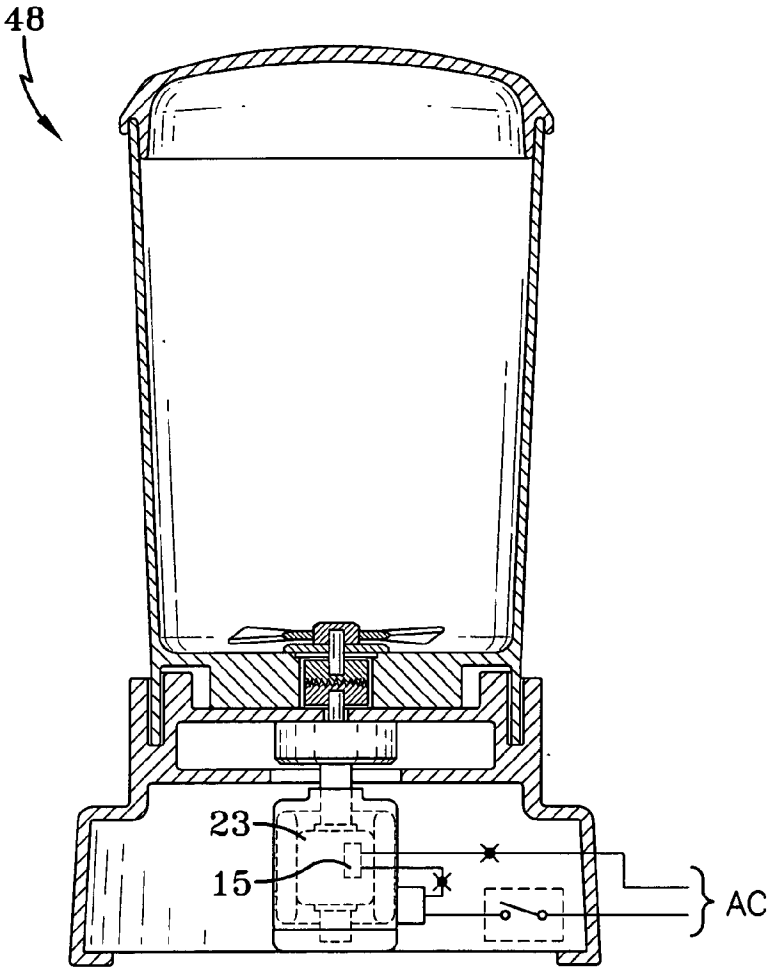
FIG. 14 is a schematic view illustrating a blender or mixer having an electric motor 23 which is equipped with the self hold thermal protector 15.
Figure 13:
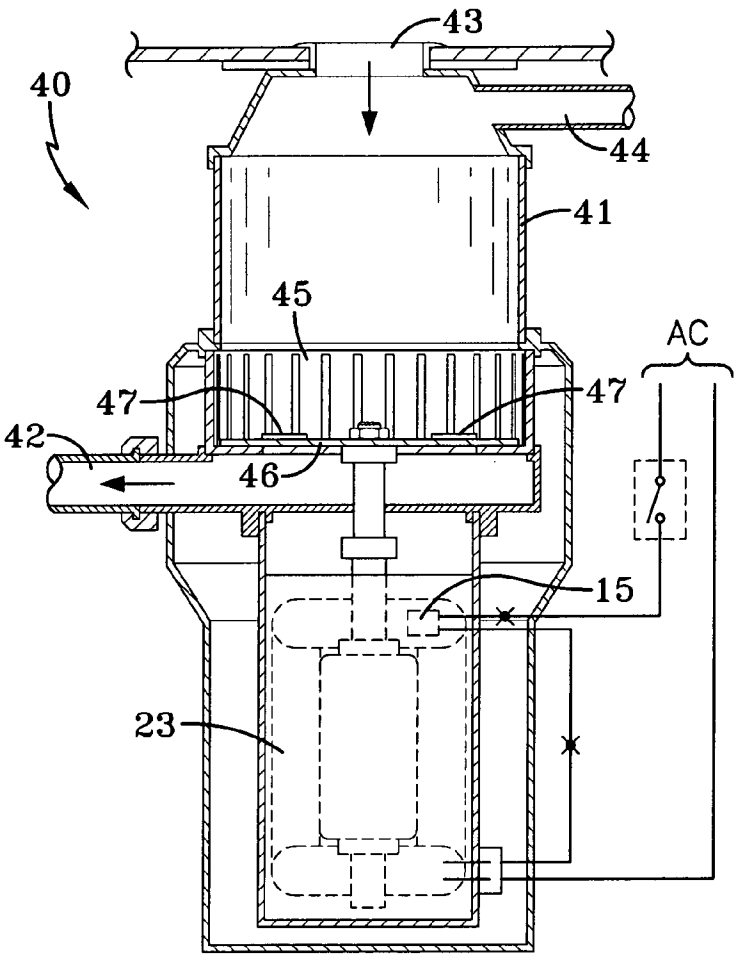
FIG. 13 is a schematic view illustrating a garbage disposal 40 which includes a shredder housing 41, a drain outlet 42, a sink inlet 43, a dishwasher inlet 44, a shredder ring 45, a flywheel 46, flyweights 47, and an electric motor 23 which is equipped with the self hold thermal protector 15.

FIG. 6 illustrates the self hold thermal protector 15 bound to the electrical binding 16 of a typical motor.

The thermal protectors of this invention are typically capable of at least 80 cycles of operation at an amperage of at least 90 amps at 120 volts of alternating current and are preferably capable of at least 100 cycles of operation at an amperage of at least 90 amps at 120 volts of alternating current. The thermal protectors of this invention are also typically capable of at least 60 cycles of operation at an amperage of at least 100 amps at 120 volts of alternating current and are preferably capable of at least 60 cycles of operation at an amperage of at least 110 amps at 120 volts of alternating current. The thermal protectors of this invention are also typically capable of at least 60 cycles of operation at an amperage of at least 120 amps at 120 volts of alternating current and are preferably capable of at least 100 cycles of operation at an amperage of at least 100 amps at 120 volts of alternating current.

The moving contact will remain in electrical contact with the fixed contact at 20 amps of continuous alternating current at 120 volts. The moving contact will typically remain in electrical contact with the fixed contact at 30 amps of continuous alternating current at 120 volts. The moving contact will preferably remain in electrical contact with the fixed contact at 35 amps of continuous alternating current at 120 volts and will most preferably remain in electrical contact with the fixed contact at 40 amps of continuous alternating current at 120 volts.

The thermal protectors of this invention are typically capable of at least 80 cycles of operation at an amperage of at least 40 amps at 240 volts of alternating current and are preferably capable of at least 100 cycles of operation at an amperage of at least 40 amps at 240 volts of alternating current. The thermal protectors of this invention are also typically capable of at least 60 cycles of operation at an amperage of at least 50 amps at 240 volts of alternating current and are preferably capable of at least 60 cycles of operation at an amperage of at least 60 amps at 240 volts of alternating current. The thermal protectors of this invention are also generally capable of at least 60 cycles of operation at an amperage of at least 70 amps at 240 volts of alternating current and at least 100 cycles of operation at an amperage of at least 60 amps at 240 volts of alternating current.

The moving contact will normally remain in electrical contact with the fixed contact at 40 amps of continuous alternating current at 240 volts and will typically remain in electrical contact with the fixed contact at 50 amps of continuous alternating current at 240 volts. In some cases the moving contact will remain in electrical contact with the fixed contact at 60 amps of continuous alternating current at 240 volts and the moving contact can remain in electrical contact with the fixed contact at 70 amps of continuous alternating current at 240 volts.

While certain representative embodiments and details have been shown for the purpose of illustrating the subject invention, it will be apparent to those skilled in this art that various changes and modifications can be made therein without departing from the scope of the subject invention. For instance, in an alternative embodiment of this invention, the bimetal blade can be attached to the can in which scenario the fixed electrical contact can be affixed to the conductive plate. In another embodiment of this invention, the electrically conductive plate can be wrapped over the can and the resistor's position on the can with the conductive metal clip is in contact with the plate and the resistor. In still another embodiment of this invention, the thermal protector can be designed wherein an internal resistive heating element such as a heater, plate or can may also contribute heat when exposed to current.

What is claimed is:

1. A thermal protector which is comprised of a bimetal blade, a moving electrical contact, a fixed electrical contact, an electrical resistor, a conductive metal can, a conductive metal plate, and a conductive metal clip wherein the bimetal blade has a fixed end and a moving end, wherein the electrical current flows substantially through the length of the bimetal blade, wherein the moving electrical contact is positional toward the moving end of the bimetal blade, wherein the moving electrical contact has a minimum volume of 0.0003 $in^3$, wherein electrical current can flow through the bimetal blade through the moving electrical contact and the fixed electrical contact at temperatures below a preset maximum operating temperature, wherein the bimetal blade bends in a manner whereby the moving electrical contact is pulled away from the fixed electrical contact at temperatures above the preset maximum operating temperature, wherein at temperatures below a reset temperature the bimetal blade bends back into a position where the moving electrical contact is pulled back into electrical association with the fixed electrical contact, wherein the electrical current can only flow through the electrical resistor when the moving electrical contact is separated from the fixed electrical contact, wherein after the moving electrical contact has been pulled away from the fixed electrical contact and at temperatures above the reset temperature the electrical current that can flow through the electrical resistor is electrically in parallel to the electrical current that flows through the bimetal blade, the moving contact and the fixed contact, wherein the electrical resistor generates sufficient heat to keep the bimetal blade above the reset temperature and to maintain the bimetal blade in a bent position wherein the moving electrical contact remains away from the fixed electrical contact during periods of continued application of the electrical current, and wherein the fixed contact is affixed to and in electrical contact with the conductive metal can, wherein the electrical current flows through the conductive metal can, wherein the fixed end of the bimetal blade is affixed to and in electrical contact with the metal plate, wherein the electrical current flows through the conductive metal can, wherein the conductive metal clip is affixed to the conductive metal can and is in electrical contact with the conductive metal can, and wherein the conductive metal clip is in electrical contact with the electrical resistor and wherein the electrical resistor is positioned between the conductive metal clip and the conductive metal plate, wherein the electrical resistor is held in contact with the conductive metal plate by the conductive metal clip, and wherein the electrical resistor is in electrical contact with both the conductive metal can and the conductive metal plate.

2. A thermal protector as specified in claim 1 wherein the thermal protector is capable of at least 60 cycles of operation at a peak amperage of at least 90 amps at 120 volts of alternating current.

3. A thermal protector as specified in claim 1 wherein the fixed electrical contact remains in electrical contact with the moving electrical contact during continuous operation at an amperage of at least 20 amps at 120 volts of alternating current.

4. A thermal protector as specified in claim 1 wherein the thermal protector is capable of at least 60 cycles of operation at a peak amperage of at least 40 amps at 240 volts of alternating current.

5. A thermal protector as specified in claim 1 wherein the fixed electrical contact remains in electrical contact with the moving electrical contact during continuous operation at an amperage of at least 15 amps at 240 volts of alternating current.

6. In an electric motor having a housing, an armature, and a coil, wherein the electric motor is powered by electricity from an electric circuit, the improvement which comprises further including the thermal protector of claim 1 in the electric motor, wherein the thermal protector is wired in series with the electric circuit that powers the electric motor.

7. In an air compressor which includes an air tank, a means for forcing air into the air tank, and an electric motor for powering the means for forcing air into the air tank, the improvement which comprises equipping the electric motor with the thermal protector of claim 1, wherein the thermal protector is wired in series with the electric circuit that powers the electric motor.

8. In a conveyor which is comprised of a conveyor belt and an electric motor for driving the conveyor belt, the improvement which comprises equipping the electric motor with the thermal protector of claim 1, wherein the thermal protector is wired in series with the electric circuit that powers the electric motor.

9. In a washing machine which includes a housing, an agitator tub, a water inlet, a water outlet, and an electric motor, the improvement which comprises equipping the electric motor with the thermal protector of claim 1, wherein the thermal protector is wired in series with the electric circuit that powers the electric motor.

10. In central vacuum system for a building that includes a series of vacuum pipes, a vacuum pump, and an electric motor, the improvement which comprises equipping the electric motor with the thermal protector of claim 1, wherein the thermal protector is wired in series with the electric circuit that powers the electric motor.

11. In a ventilation fan that includes a fan blade and an electric motor, the improvement which comprises equipping the electric motor with the thermal protector of claim 1, wherein the thermal protector is wired in series with the electric circuit that powers the electric motor.

12. In a vacuum cleaner that includes a housing, a vacuum pump, a dust collector, and an electric motor, the improvement which comprises equipping the electric motor with the thermal protector of claim 1, wherein the thermal protector is wired in series with the electric circuit that powers the electric motor.

13. In a garbage disposal that includes a shredder housing, a drain outlet, a sink inlet, a dishwasher inlet, a shredder ring, a flywheel, at least two flyweights that are affixed to the flywheel, and an electric motor that is adapted for turning the flywheel, the improvement which comprises equipping the electric motor with the thermal protector of claim 1, wherein the thermal protector is wired in series with the electric circuit that powers the electric motor.

14. A thermal protector as specified in claim 1 wherein the resistor is comprised of at least 2 resistor components.

15. A thermal protector as specified in claim 1 wherein the bimetal blade, the moving electrical contact, and the fixed electrical contact are situated between the can and the plate wherein the can and the plate are electrically isolated by a non-conductive gasket which is positioned between the can and the plate.

16. A thermal protector as specified in claim 15 wherein the electrical resistor is comprised of at least two positive temperature coefficient resistors.

17. A thermal protector as specified in claim 16 wherein a first terminal is affixed to the conductive metal can, wherein a second terminal is affixed to the conductive metal plate, wherein a first lead wire is affixed to the first terminal, wherein a second lead wire is affixed to the second terminal, and wherein the conductive metal can, the conductive metal plate and the conductive metal clip are confined within a non-conductive sleeve.

18. In a blender or mixer that includes an electric motor, the improvement which comprises equipping the electric motor with the thermal protector of claim 1, wherein the thermal protector is wired in series with the electric circuit that powers the electric motor.

* * * * *